US006115988A

United States Patent [19]

Reisdorff

[11] Patent Number: 6,115,988

[45] Date of Patent: Sep. 12, 2000

[54] METHODS OF RAISING UTILITY POLE TRANSMISSION HARDWARE

[75] Inventor: Robert A. Reisdorff, Seward, Nebr.

[73] Assignee: Laminated Wood Systems, Inc., Seward, Nebr.

[21] Appl. No.: 08/968,279

[22] Filed: Nov. 12, 1997

[51] Int. Cl.[7] ..... E04H 12/34

[52] U.S. Cl. ..... 52/741.14; 52/123.1; 52/165; 52/170; 52/514; 52/745.17

[58] Field of Search ..... 52/123.1, 169.13, 52/169.9, 165, 170, 514, 745.05, 745.17, 745.1, 741.14; 405/230

[56] References Cited

U.S. PATENT DOCUMENTS

| | | | |
|---|---|---|---|
| 253,743 | 2/1882 | Mensing . | |
| 877,268 | 1/1908 | Van Buren . | |
| 1,679,297 | 7/1928 | Ehrler . | |
| 2,040,010 | 5/1936 | McMahon . | |
| 2,530,807 | 11/1950 | Campbell . | |
| 3,317,185 | 5/1967 | Burk et al. . | |
| 3,350,822 | 11/1967 | Nachazel . | |
| 3,464,169 | 9/1969 | Potain . | |
| 4,044,513 | 8/1977 | Deike . | |
| 4,048,779 | 9/1977 | Valenziano et al. | 52/514 X |
| 4,096,673 | 6/1978 | Deike . | |
| 4,097,165 | 6/1978 | Quayle | 52/514 X |
| 4,197,689 | 4/1980 | DeMuth . | |
| 4,327,534 | 5/1982 | Mastalski et al. . | |
| 4,678,372 | 7/1987 | Cousty | 52/745.17 X |
| 4,697,396 | 10/1987 | Knight . | |
| 4,756,130 | 7/1988 | Burtelson | 52/170 |
| 4,802,317 | 2/1989 | Chandler . | |
| 4,991,367 | 2/1991 | McGinnis | 52/170 |
| 5,031,370 | 7/1991 | Jewett . | |
| 5,337,469 | 8/1994 | Richey | 52/170 X |
| 5,383,749 | 1/1995 | Reisdorff et al. . | |
| 5,661,946 | 9/1997 | Davis . | |
| 5,794,387 | 8/1998 | Crookham | 52/123.1 X |

*Primary Examiner*—Carl D. Friedman
*Assistant Examiner*—Timothy B. Kang
*Attorney, Agent, or Firm*—Reising, Ethington, Barnes, Kisselle, Learman & McCulloh, P.C.

[57] ABSTRACT

A method of raising the transmission cables carried by a utility pole having a base end with a ground foundation supporting the pole in upright position, without disturbing the pole foundation or disconnecting the cables, includes the steps of anchoring opposed, circumferentially spaced elongate pole support members to extend upwardly along the pole and severing the pole to define a first pole supported by the pole foundation and a second pole supported by the first pole; fixing the support members to the first pole and slidably banding them to the second pole; raising the second pole above the first pole to a level remaining below the upper ends of the support members; and fixing the lower end of the second pole within and to the upper ends of the support members at a spaced distance above the first pole.

13 Claims, 4 Drawing Sheets

10
SL
12
G
10
10
13a
13
13a
12
13b
10
13a
13
12
14
10
13a
13
13a
15
12
SL
14
G
13
15
10

FIG-11
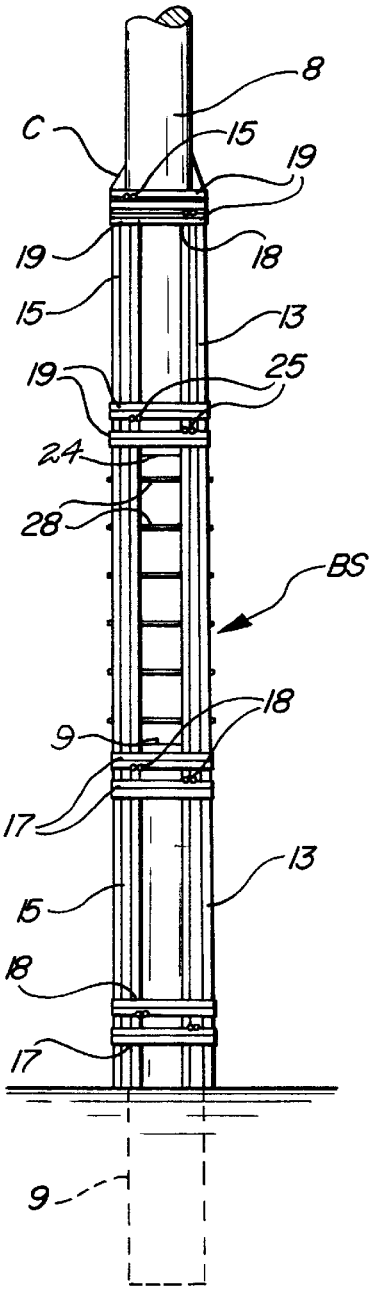
FIG-13
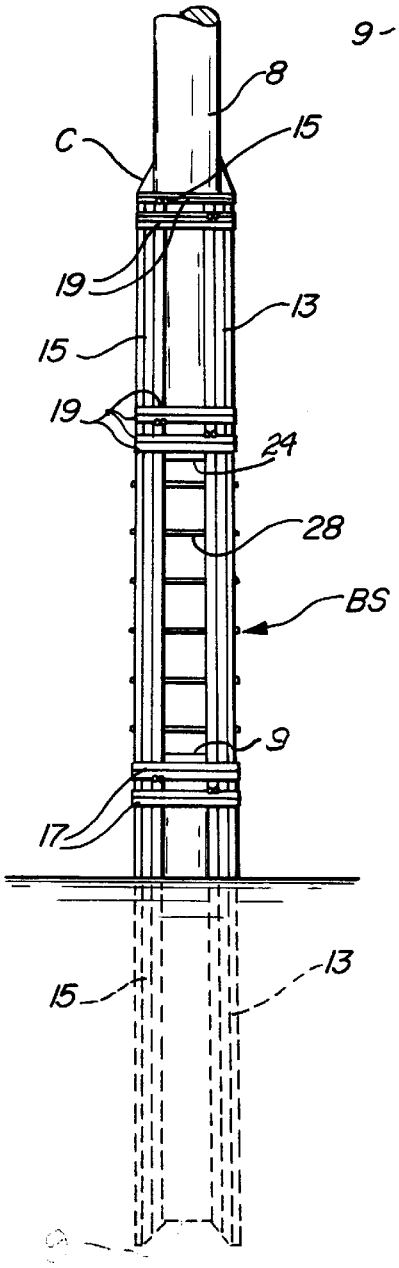
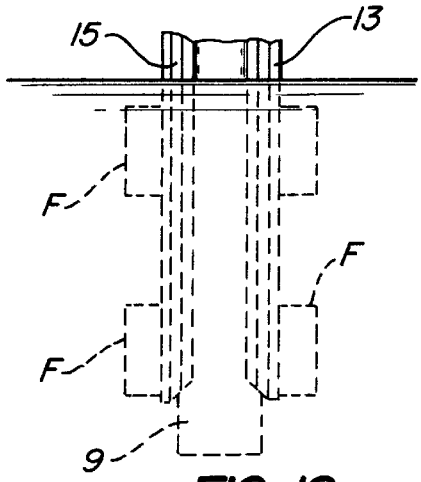
FIG-12
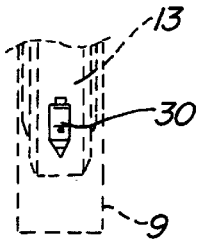
FIG-14

METHODS OF RAISING UTILITY POLE TRANSMISSION HARDWARE

BACKGROUND OF THE INVENTION

The present invention relates to methods of raising the transmission and/or communication cables and other hardware carried by a utility pole without disturbing the pole foundation or necessitating disconnecting and reconnecting the cables and other framing and hardware.

The electric utility industry is seeking to correct existing ground clearance problems or increase the capacity of existing electric power transmission lines while maintaining the ground clearance which must be observed below the height of the power transmission cables or lines. Utilities have increased the ampacity carried by power lines to meet ever-increasing peak loading conditions, such as, for example, occur with seasonal air-conditioning loads. This increased ampacity heats up the lines, which then begin to sag further.

Typically, the industry has added a pole top extension to the top end of a utility pole to eliminate the need to replace or change out the existing utility pole. When pole top extensions are utilized, the power lines, communication lines, and other equipment carried must be disconnected and reconnected to the top of the pole extension which, of course, results in considerable downtime for the entire power transmission or communication system. Moreover, such pole top extensions are not rated for heavy equipment such as transformer support, and in many instances, the only acceptable approach has been to remove the pole and replace it with a longer pole.

For a discussion of conventional, commercial extensions which have been used in very recent years, attention is invited to U.S. Pat. No. 5,661,946, which I incorporate herein by reference.

SUMMARY OF THE INVENTION

The present method is concerned with increasing the height of a utility pole without the need of shutting down the operation of the poles or pole clusters which typically may be located 1000 feet apart, without removing and replacing the base of each pole from the earth, or disturbing its position in the earth by raising it. The pole is braced while severing it to define a first pole or pole portion supported by the pole foundation, and a second pole or pole portion caged by elongate support members. During severing of the pole, the pole is supported by generally opposed, circumferentially spaced elongate support members which extend upwardly along the pole to brace both the first pole and the second pole. The support members are fixed to the first pole and slidably banded around the second pole. Hydraulic jacks connected between the first and second poles may then be provided to raise the second pole to a predetermined level above the first pole. Thereafter, the hydraulic jacks are removed and the lower end of the raised second pole is fixed within and to the upper ends of the support members in a cable raising position. Typically, the second pole may be raised five feet or more above the first pole.

A prime object of the invention is to provide a method of increasing the height of the existing electric utility and/or telecommunication cables and hardware which are supported by a utility pole, without the need for removing the cables and hardware and shutting down the system.

Another object of the invention is to provide a method of raising the cables and other equipment without removing and replacing the poles.

Still another object of the invention is to provide a method which is readily practiced, and permits accomplishment of its function in a reliable and economical manner.

Still a further object of the invention is to provide a method of using the power transmission lines and other equipment carried by utility poles in a manner to maintain the foundation strength of the poles, and provide a structure which is extremely durable and will withstand wind storms and other climactic conditions.

Other objects and advantages of the invention will become apparent with reference to the accompanying drawings and the accompanying descriptive matter.

BRIEF DESCRIPTION OF THE DRAWINGS

The presently preferred embodiments of the invention are disclosed in the following description, and in the accompanying drawings, wherein:

FIG. 11 is side elevational view, similar to FIG. 8, but illustrating an alternative method in which the sole support members do not extend into the ground;

FIG. 12 is a similar fragmentary view of another embodiment in which flanges are fixed on the lower ends of the pole support members;

FIG. 13 is a similar fragmentary view of still another embodiment; and

FIG. 14 is a similar fragmentary view of still a further embodiment.

DETAILED DESCRIPTION OF THE INVENTION

Figure 1:
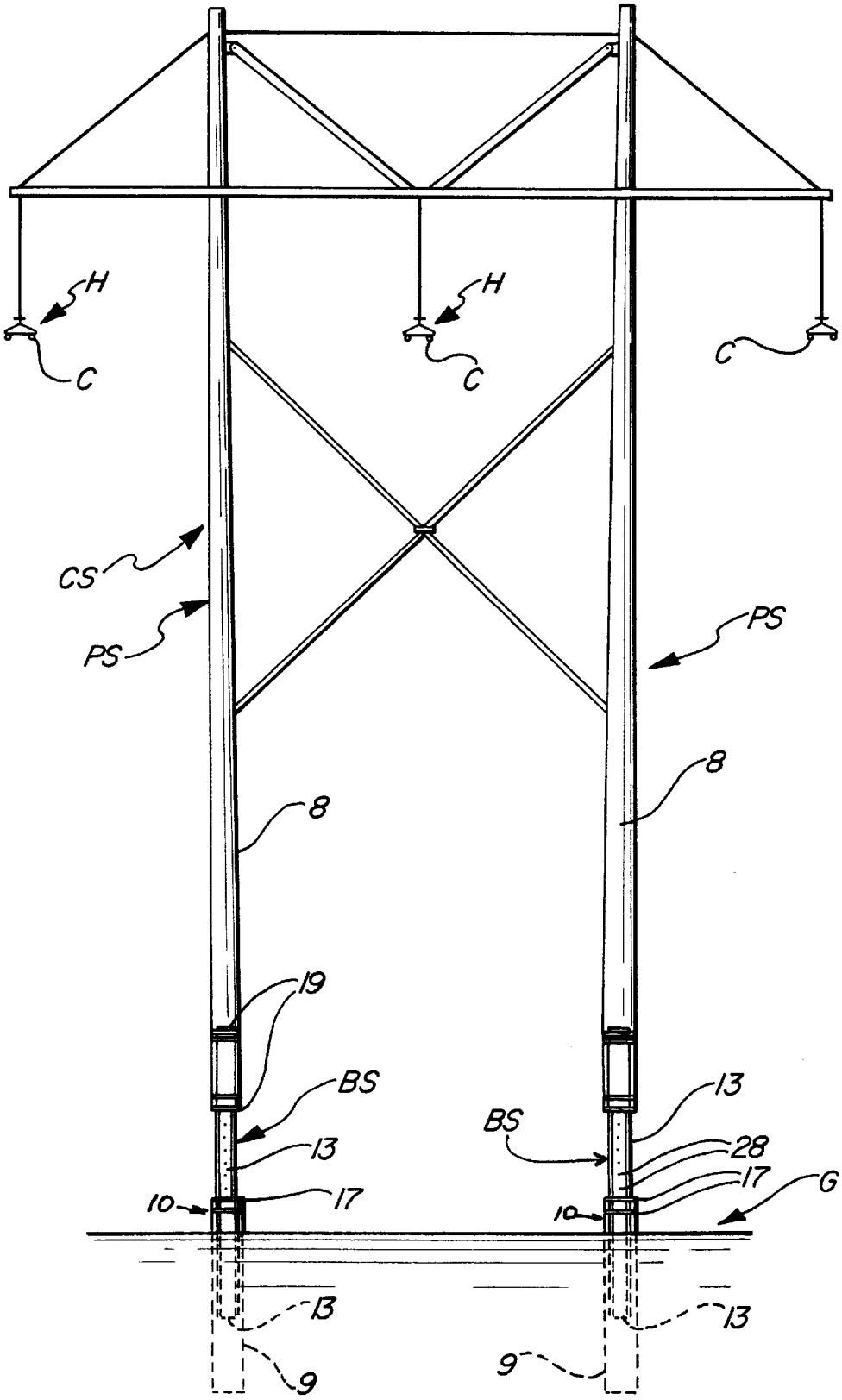
FIG. 1 is a side elevational view illustrating a retrofitted pole cluster wherein the power transmission elements have been raised practicing the method of the present invention.

In FIG. 1, the overall cluster structure, generally designated CS and commonly referred to as an H-Frame tangent structure, is shown as comprising spaced apart, retrofitted pole structures, generally designated PS for supporting power transmission hardware, generally designated H, including power transmission conductors or cables such as shown at 7, telecommunications cables, transformers, guying, and other electrical hardware and equipment. While two pole structures PS are shown for convenience sake, it is to be understood that the cluster could be a three pole structure or four pole cluster structure, or even a single pole structure could have been illustrated. As FIG. 1 indicates, the pole structures PS are embedded a pre-designated distance in the ground, and typically they extend into the ground a distance of 10% of the initially embedded pole length plus 2 feet. Each retrofitted pole structure PS, in FIG. 1, includes an upper pole section or pole 8 and a lower pole or pole section 9, separated by bridging and support structure generally designated BS.

Figures 2, 3, 4, 5:
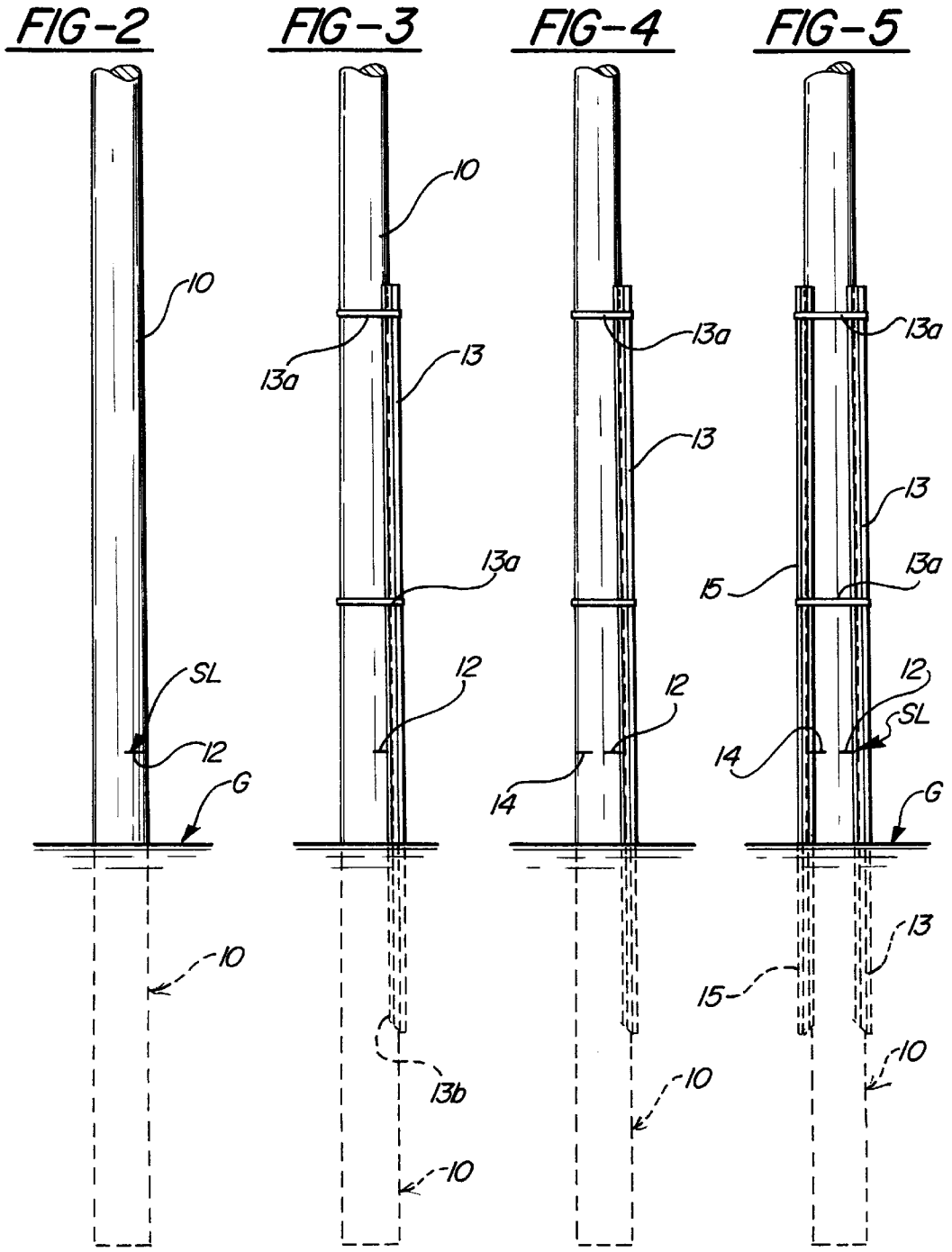
FIGS. 2–7 are side elevational views sequentially illustrating the various method steps which are followed in retrofitting the structure.
Figure 10:
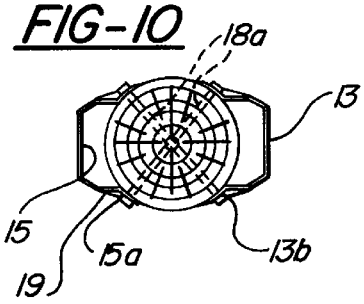
FIG. 10 is a sectional, elevational view taken on the line 10—10 of FIG. 8.

In FIG. 2, a typical originally installed pole 10, which is embedded in the ground G a pre-designated depth to provide a solid foundation for the pole 10, is shown as having been partially cut, notched, or slit, as at 12, at what may be termed a "severing level" generally designated SL. In the next step in the process, a preferably steel channel or pole support, generally designated 13, is temporarily banded to the pole 10 as at 13*a* above the level SL and driven into the ground alongside the pole 10. It will be noted that in final position the channel 13 extends upwardly a considerable distance along the pole beyond the slit 12. Typically, the member 13 may be 20 feet in length and driven a distance of 5–6 feet into the ground alongside the pole. As FIG. 10 shows, the channel or support member 13 is configured at its ends 13*b* (see FIG. 10) to the shape of the pole to guide on the pole, and may be said to embrace it. The banding 13*a* may be conventional, girth adjustable, removable nylon banding which circumferentially holds the channel to the pole 10 without binding it to the point it interferes with downward movement of the channel 13. Alternatively, a conventional tightenable chain of the type shown in the present assignee's U.S. Pat. No. 5,383,749, which is incorporated herein by reference, may be used. This adjustable chain is shown at 37 in the patent and the same driving rig disclosed in U.S. Pat. No. 5,383,749, or other suitable equipment, may be used to drive the channel 13 down into position.

The next step in the method is to cut a second slit or notch 14 on the same level SL on the opposite side of the pole, which again does not extend all of the way through the pole to the slit 12. Then, after removing banding 13*a* and resecuring it to also embrace a second opposed pole support or channel 15 in the same manner, the second extension or channel member 15, which is identical to member 13, is driven into the ground on the opposite side of the pole, as shown in FIG. 5. Both slits 12 and 14 are cut deeply enough to extend circumferentially beyond the members 13 and 15 and the channel 15 is formed with similar pole engaging edges 15*a* as shown in FIG. 10.

Figure 6:
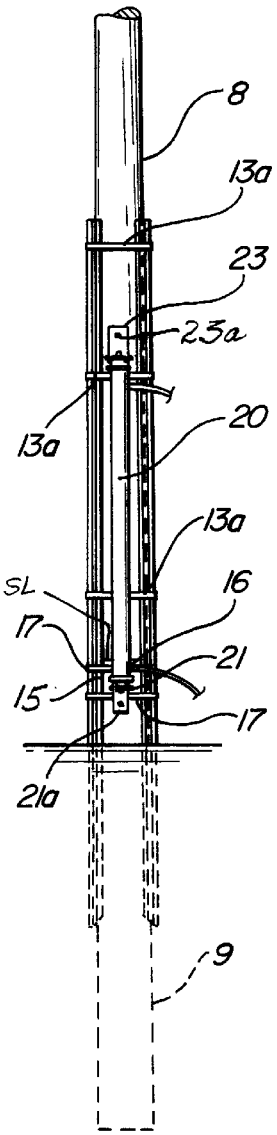
Figure 7:
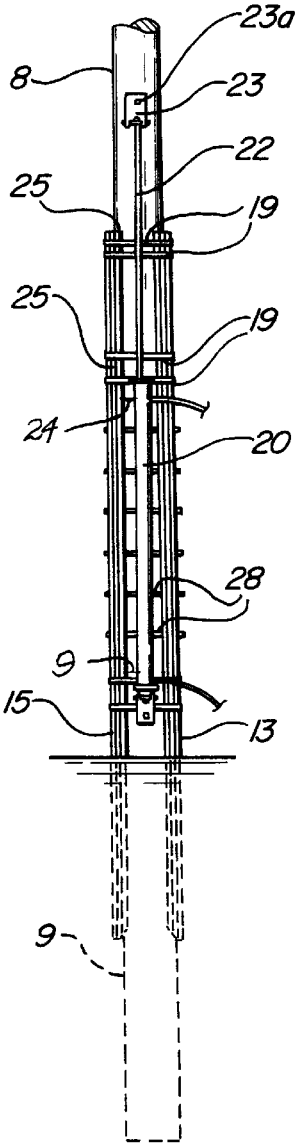

In FIG. 6, it will be noted that the banding 13*a* is rearranged and a new lower band 13*a* added, and the original pole 10 is then cut through completely between the members 13 and 15, as at 16, at the same level SL. A complete severance of the original pole 10 at 16 between slits 12 and 14, as shown in FIGS. 6 and 7, forms the base pole 9 and the second separate pole or pole portion designated 8. The extension members or channels 13 and 15 are then permanently affixed to the lower pole or pole portion 9 by through bolts 18, and by steel bands 17 which embrace the members 13 and 15, and the pole 9, and bolt to it. The bands 17 may also be of the type described in the aforementioned patent which have their overlapping portions secured by a crimping tool.

Then, at opposite sides of the base pole 9, a pair of hydraulic cylinders or jacks 20 are provided externally circumferentially between the members 13 and 15 to attach to the base pole 9, as at tees 21 which have fasteners 21*a* reliably, releasably securing them in position. The cylinder rods 22 of jacks 20 are secured to the upper poles or pole portions 8 at the tees 23 by similar fasteners 23*a*. The members 13 and 15 are temporarily banded to the pole portion 8 as at 13*a* in a manner to accommodate upward sliding movement of the pole portion 8.

As FIG. 7 demonstrates, the next step is to utilize the hydraulic jacks 20 to raise the pole 8 upwardly a distance of typically 5 feet to the level 24. Alternatively, a crane could be utilized. Once this has been accomplished, the bands 13*a* which previously permitted the upper pole 8 to slide upwardly, may be removed and permanent steel bands 19, similar to bands 17, may be bolted in position. Bolts 25 of the same character as bolts 18, which extend all the way through the pole, additionally are installed. The bolt members 18*a* , as FIG. 10 indicates, which secure the edges 13*b* of the members 13, and the edges 15*a* of the members 15 to the poles 8 and 9 extend all the way through the poles, as shown in FIG. 10.

Figure 8:
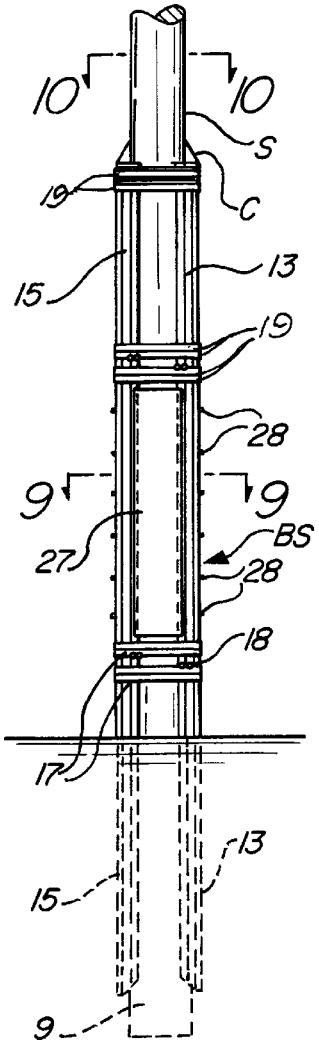
FIG. 8 is a side elevational view on a slightly different scale.
Figure 9:
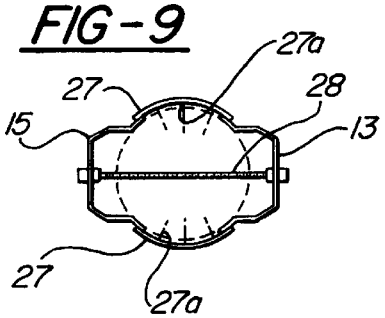
FIG. 9 is a sectional elevational view taken on the line 9—9 of FIG. 8.

Threaded rods 28, provided with nuts and lock-nuts, are secured at vertical intervals, i.e., 18 inches, between poles 8 and 9, as shown in FIG. 7 to further unite the members 13 and 15. The rods 28 are inserted progressively as the pole 8 is moved upwardly beginning with the two lower rods 28. One rod 28 is always kept in place above a rod which is being tightened down. Thereafter, the releasably installed, hydraulic jacks 20 may be removed by simply backing off the bolts or fasteners 21*a* and 23*a* which secure to the wood pole portions 9 and 8 respectively. The space embraced by the bridging structure BS between the poles 8 and 9 is then covered by elongate curvilinear steel plates 27 which fasten or nail as at 27*a* to the poles 8 and 9 and overlie the channel edges 13*b* and 15*a*. Surrounding caps C (shown only diagrammatically) which nail to the pole and overlap the upper ends of the channels 13 and 15 are also provided. In FIG. 8, a distance of 5 feet is provided between the upper end of the lower pole portion 9 and the lower end of the upper pole portion 8, and the structural rise is, of course, 5 feet. The bolts 17, 18, 18*a*, 19, and 25, bands 17 and 19, and rods 28 may be generically referred to as fastener elements.

In FIG. 11, an alternative method is illustrated in which the principal difference between FIGS. 8 and 11 is that the channels 13 and 15 are not driven into the ground. In this case, the severing level SL is raised and the channels 13 and 15 are secured to the pole section 9 by two pairs of steel bands 17 and additional bolts 18. In this installation, there is adequate ground line capacity to support the increased structural height.

In FIG. 12, an embodiment of the invention is illustrated in which pairs of linear flanges F are welded or bolted to the lower ends of the members 13 and 15, as shown, to provide additional foundation stabilization in some types of earth.

In FIG. 13, an alternative method is indicated in which the channels 13 and 15 are driven down below the lower end of the pole portion 9 when it is suspected that the lower end of the pole may be decayed to some extent at its lower end. In this case, the severing level SL is lowered, as will be seen.

Finally, in FIG. 14, still another embodiment is illustrated in which flip feet 30 of the character disclosed in the aforementioned U.S. Pat. No. 5,383,749 are utilized for increased uplift and thrust capacity.

Typically, the utility poles in use today are wood poles, or laminated wood poles, but may be metallic or plastic, or otherwise constituted in nature. Typically, the channels 13 and 15 are installed by driving them into place, or digging them into place.

The disclosed embodiment is representative of a presently preferred form of the invention, but is intended to be illustrative rather than definitive thereof. The invention is defined in the claims.

I claim:

1. A method of raising the transmission cables carried by a utility pole having a base end enclosed by a ground foundation supporting the pole in upright position, without disturbing the pole foundation, comprising the steps of:

a. arranging generally opposed, circumferentially spaced, elongate, generally pole embracing, pole support members, with upper ends, to extend upwardly along the pole and dispose said upper ends at a first level a predetermined distance from the ground and severing the pole at a severing level below said first level to define a first pole supported by the pole foundation and a second pole supported by said first pole and circumferentially braced by said pole support members; said severing being sequentially effected with said pole being partially severed on one side and one of said support members then being positioned and secured alongside the pole on the said one side, said pole then being partially severed on the opposing side and the other support member then being positioned and secured alongside said pole on said opposing side, the remainder of said pole circumferentially between said pole support members then being severed to complete severing of said pole;

b. raising said second pole a predetermined distance above said first pole to a level remaining below said upper ends of said pole support members; and c. fixing the lower end of said second pole within and to said upper ends of said pole support members at a spaced distance above said first pole in a cable raising position.

2. The method of claim 1 wherein said raising is accomplished by releasably securing hydraulic cylinders between said first and second poles and activating said cylinders in unison to extend their length.

3. The method of claim 2 wherein the upper ends of said hydraulic cylinders are releasably secured to said second pole at a spaced distance below the upper ends of said support members.

4. The method of claim 1 comprising covering the circumferential gap between said support members with steel plate bridging vertically between said first and second poles.

5. The method of claim 1 wherein step c includes fixing rigid support member embracing bands around said second pole and pole support members.

6. The method of claim 1 comprising ultimately permanently bolting said pole support members to said first and second poles and ultimately permanently metal-banding said pole support members to said first and second poles.

7. The method of claim 1 wherein said pole support members are driven into the ground to anchor said pole support members a distance approximating at least half the depth the pole extends into the ground.

8. The method of claim 1 comprising bolting said support members together at vertically spaced intervals vertically between said first pole and raised second pole.

9. The method of claim 1 wherein said pole support members have curvilinear edges conforming to said poles and said edges guide said second pole as said second pole is raised upwardly.

10. A method of raising the transmission cables carried by a utility pole having a base end enclosed by a ground foundation supporting the pole in upright position, without disturbing the pole foundation, comprising the steps of:

a. securing circumferentially spaced, elongate, generally pole embracing, rigid ground supported pole support members with upper ends, to extend upwardly along the pole and dispose said upper ends at a first level a predetermined distance from the ground and severing the pole at a severing level below said first level to define a first pole supported by said pole foundation and a second pole resting on and supported by said first pole and circumferentially braced by said pole support members;

b. without raising said first pole, raising said second pole a predetermined spaced distance above said first pole to a level remaining below said upper ends of said pole support members; and c. fixing the lower end of said second pole within and to said upper ends of said pole support members at a spaced distance above said first pole in a cable raising position.

11. The method of claim 10 wherein said pole support members are fixed to said first pole below said severing level before said severing is completed.

12. The method of claim 10 comprising bolting said spaced apart support members together at vertically spaced intervals vertically between said first pole and said raised second pole.

13. A method of raising the transmission cables carried by a utility pole having a base end enclosed by a ground foundation supporting the pole in upright position, without disturbing the pole foundation, comprising the steps of:

a. securing a rigid elongate pole support member with an upper end, having a configuration generally embracing said pole and extending upwardly along said pole to dispose said upper end at a first level a predetermined distance from the ground and severing said pole at a severing level below said first level to define a first pole supported by the pole foundation and a second pole resting on and supported by the first pole and laterally braced by said pole support member; said severing being sequentially effected with said pole first being partially severed on one side and said pole support member being secured to said first pole at said one side before further severing is accomplished;

b. without vertically moving said first pole, raising said second pole a spaced vertical distance above said first pole to a level remaining below the upper end of said pole support member; and c. fixing the lower end of said second pole to said upper end of said pole support member to support said second pole in a cable raising position.

* * * * *